United States Patent [19]

Goulter et al.

[11] Patent Number: 4,645,209

[45] Date of Patent: Feb. 24, 1987

[54] PATTERN-FORMATION STRATEGY BOARD GAME

[76] Inventors: Victor H. Goulter; Barbara W. Goulter, both of 485 Molimo Dr., San Francisco, Calif. 94127

[21] Appl. No.: 730,076

[22] Filed: May 3, 1985

[51] Int. Cl.[4] ..... A63F 3/00

[52] U.S. Cl. ..... 273/271; 273/287; 273/291

[58] Field of Search ..... 273/236, 264, 267, 271, 273/275, 282, 287, 291

[56] References Cited

U.S. PATENT DOCUMENTS

| | | | |
|---|---|---|---|
| 597,755 | 1/1898 | Wilson | 273/287 |
| 818,237 | 4/1906 | Elburn | 273/271 |
| 1,119,870 | 12/1914 | Pettit | 273/291 |
| 1,714,792 | 5/1929 | Kurihara | 273/291 X |
| 2,722,424 | 11/1955 | Hum | 273/264 X |
| 3,190,655 | 6/1965 | Louie | 273/291 X |
| 4,513,974 | 4/1985 | Lin | 273/287 |

FOREIGN PATENT DOCUMENTS

| | | | |
|---|---|---|---|
| 24620 | 1/1906 | Austria | 273/287 |
| 927653 | 5/1947 | France | 273/271 |
| 2326216 | 4/1977 | France | 273/287 |
| 39436 | 3/1977 | Japan | 273/275 |
| 1244121 | 8/1971 | United Kingdom | 273/275 |

*Primary Examiner*—Paul E. Shapiro

*Attorney, Agent, or Firm*—David Pressman

[57] ABSTRACT

A board game using an elevated board (20) having fourteen rows (22), each of fourteen holes (24), so as to total ninety-six holes. The board is divided into four quarters (21), each of forty-nine holes, by lines (23) into which two to four players play in turn, by placing colored playing pieces (48) from swivel-mounted storage drawers (43) restrained from free movement by friction washer (33), each player attempting to construct patterns (61, 62, 63, 64 and 65) in order to score points. Playing pieces (48) have colors at one end (50) for forming patterns (67) and are reversible to a transparent end (52) for cancellation after scoring by placing score pegs (54) in appropriate holes (29), color identification of inverted playing pieces (48) made possible through transparent end (52) for visual score checking at any time. Each player also attempts to prevent his or her opponents from forming patterns by inserting a playing piece to block pattern formations. When four patterns are completed in first started quarter, either player can move into next quarter, but only if his or her first move will either complete or stop a pattern which straddles the border. Playing piece ends can be made touch-identifiable in shape of end (70, 71, 72, 73) for blind players. Pattern shapes (26) are permanent on board margin (25) on the sides of board (20) for international player reference.

18 Claims, 12 Drawing Figures

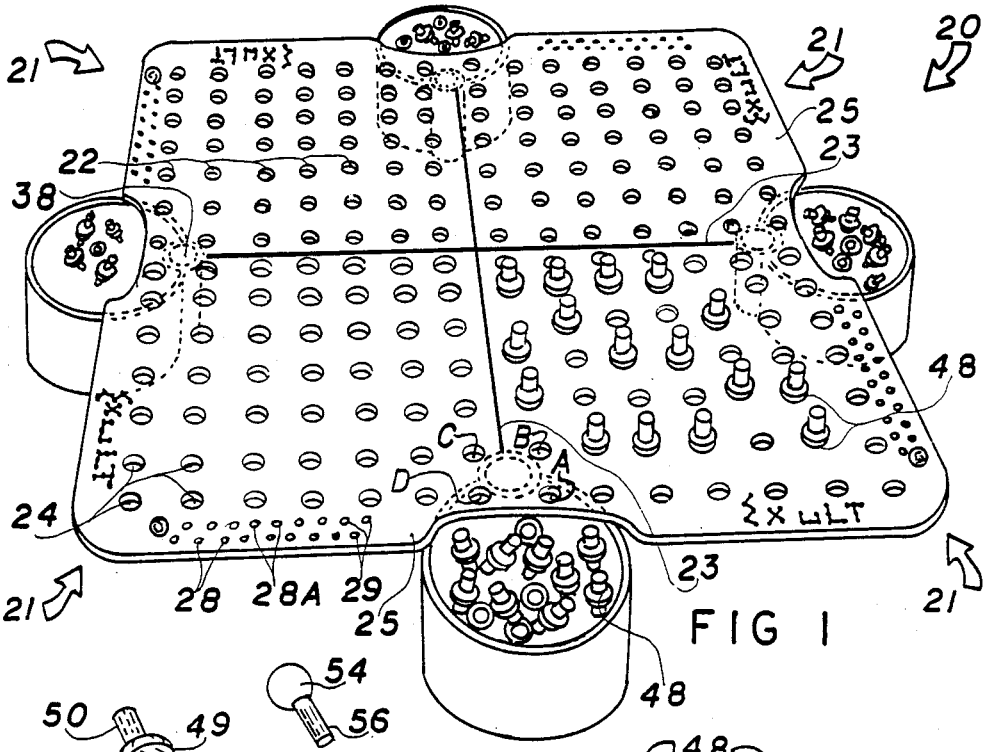
FIG 1
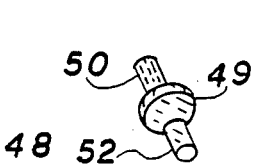
FIG 3A
FIG 3B
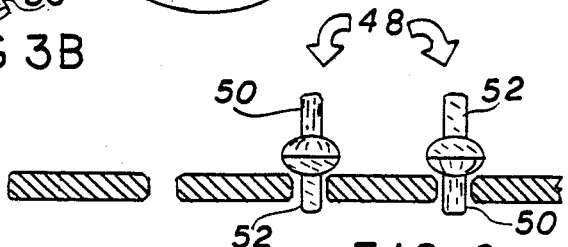
FIG 2
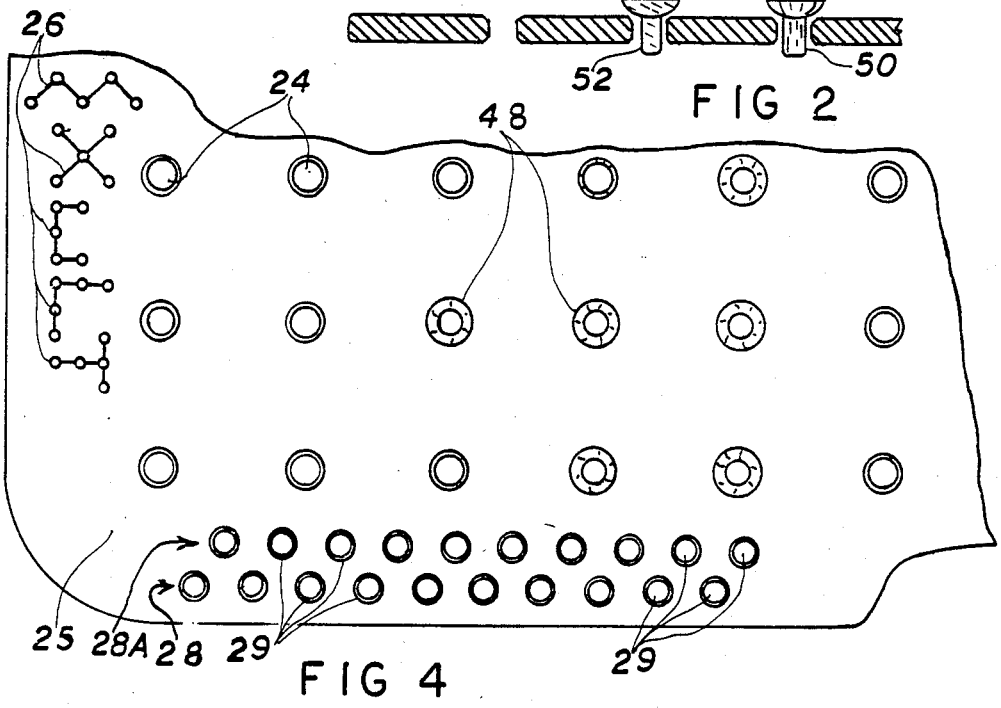
FIG 4

PATTERN-FORMATION STRATEGY BOARD GAME

BACKGROUND—FIELD OF THE INVENTION

The present invention relates to a game, in particular to a board game for two to four players.

BACKGROUND—DESCRIPTION OF PRIOR ART

In the past, many board games were suited only for use by players of approximately the same age group, sex, intelligence, or level of education. Also, prior-art games required a relatively large and hence unwieldly variety of playing pieces, such as dice, a dice cup, buildings (e.g., in *Monopoly*), paper money (which could be blown away or damaged, instruction cards, etc. Most board games also required a table for support; thus, an unintentional bump would send pieces flying, ending the game. Additionally, non-playing persons were needed to act as bankers, dealers, etc. Few board games could be played while travelling in a car, train, bus, boat or plane. Also, many board games were language-oriented, requiring all players to speak the same language. Those board games which employed dice depended largely on chance.

A few classic board games were based primarily on strategy and avoided some of these problems; i.e., chess, checkers, Chinese checkers, backgammon, etc., could be played by persons of different backgrounds, ages or languages. Some were even available in special models which provided means to hold the pieces securely in place. Chess, however, was difficult to learn and master, requiring the ability to think many moves ahead. Checkers, go, Chinese checkers, and other strategy board games which used simpler components and moves than chess, were easier to grasp but more limited in the kinds of moves that were possible, therefore tending to become tedious. None of these combined ease of learning with a wide variety of kinds of possible moves and goals, involving technical, strategic and emotional components, with the possibility of risk-taking for enhanced pay-offs, and the opportunity for bluff, mind-reading and planning ahead, including setting up positions for later use, as well as the ability to use one's sense of observation and spatial relations.

OBJECTS AND ADVANTAGES

Accordingly, one purpose of the present invention is to provide a game which suits all ages, or a mixture of all ages, e.g., one player may be eight years old and another eighty, and in which players can be of different cultures, lanugages or educational levels, without one having an advantage over another.

Another purpose is to provide a game which is compact, all pieces being packed and carryable together. A further purpose is to provide a game which can be played while travelling in a car, bus, plane, train or boat, in addition to homes, hospitals, pleasure resorts, parks, beaches, clubs and any waiting area. An additional purpose is to provide a game in which players can, under some circumstances, cooperate as well as compete with one another.

A still further purpose is to provide a game which teaches observation and concentration; which allows for risk-taking for either a loss or a rich reward; which trains the players in spatial relations and careful planning of strategy as well as in quick thinking; which allows players to bluff or play in such manner as to puzzle the opponents by moves which appear unintelligent yet which prove useful by distracting the opponents or causing them to lose concentration. Also, yet further purposes are to provide a game which allows players to play both offensively and defensively at the same time, to provide a game in which the board can be made into an attractive piece of furniture or decoration, and to provide a game which can be played by the blind, or the blind and sighted together.

Still further objects, purposes and advantages will become apparent from a consideration of the ensuing description, taken in conjunction with the accompanying drawings.

BRIEF DESCRIPTION OF DRAWINGS

FIG. 1 is a perspective elevational view of game apparatus according to the present invention.

FIG. 2 is a cross-sectional view of part of the board of the game apparatus of FIG. 1, showing a side view of two playing pieces in position.

FIG. 3A is a full size perspective view of a playing piece.

FIG. 3B is a full size perspective of a score-keeping peg.

FIG. 4 is a full size top view of a portion of one corner of the board.

DETAILED DESCRIPTION OF THE PREFERRED EMBODIMENT—FIGS. 1 TO 5

Figure 5:
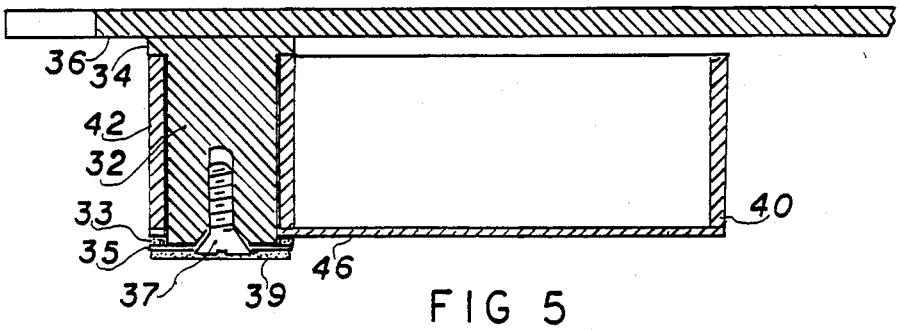
FIG. 5 is a full size cross sectional view of a support post and a swing-out drawer which is attached to the board and which elevates it.

Beginning with FIG. 1, a raised or elevated board 20 about 35 to 38 cm (14 to 15 in) square and 2 to 6 mm (3/32 to ¼ in) thick is drilled or formed with fourteen rows 22 each having fourteen holes 24 at a distance fo 20 to 25 mm (⅛ to 1 in) apart. Holes 24 are 4 to 6 mm (3/16 to ¼ in) in diameter and are slightly countersunk on each side as shown in FIG. 2.

A border 25, about 20 to 25 mm (¾ to 1 in) wide, surrounds the grid area of the board. Two rows 28 and 28A, each having ten holes 29, best shown in FIG. 4, are drilled or formed in zig zag or staggered formation along the left hand portion of the border area on each side. These extend for about one third of the length of each side as shown in FIG. 1. Holes 29 are 3 to 4 mm (⅛ to 2/16 in) in diameter and are about 6 mm (¼ in) apart and are countersunk.

Board 20 is further divided into four quarters 21 by dividing lines or grooves 23, FIG. 1.

Figure 6:
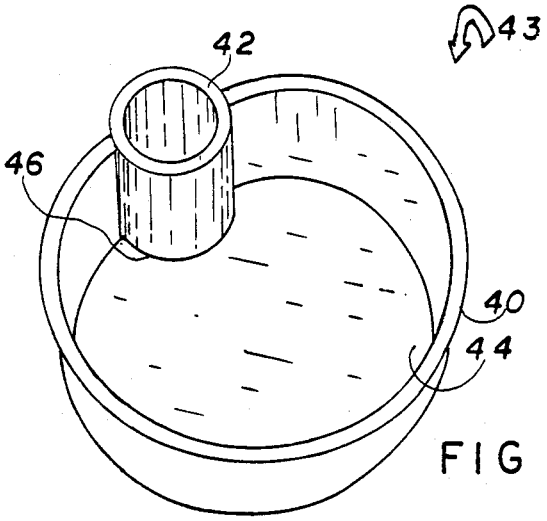
FIG. 6 is an elevated perspective view of the swing-out drawer for holding playing pieces.

Support posts 32, best shown in FIG. 5, are from 12 to 20 mm (½ to ¾ in) in diameter and have a 2 to 3 mm (3/32 to ⅛ in) thick flange 34 about 25 mm (1 in) in diameter at their upper ends. Each post is 25 to 30 mm (1 to 1¼ in) long and is attached by adhesive or other means to the underside 36 or board 20. Posts 32 are positioned centrally between the seventh and eighth vertical rows and in between the first and second horizontal rows from each side, as shown at 38, FIG. 1. Thus, the posts will not interfere with the four adjacent holes, marked A, B, C and D. Drawer wall 40, FIGS. 5 and 6, is adhesively attached to a cylinder member 42 (FIG. 6), which is journalled to rotate freely on post 32.

Figure 10:
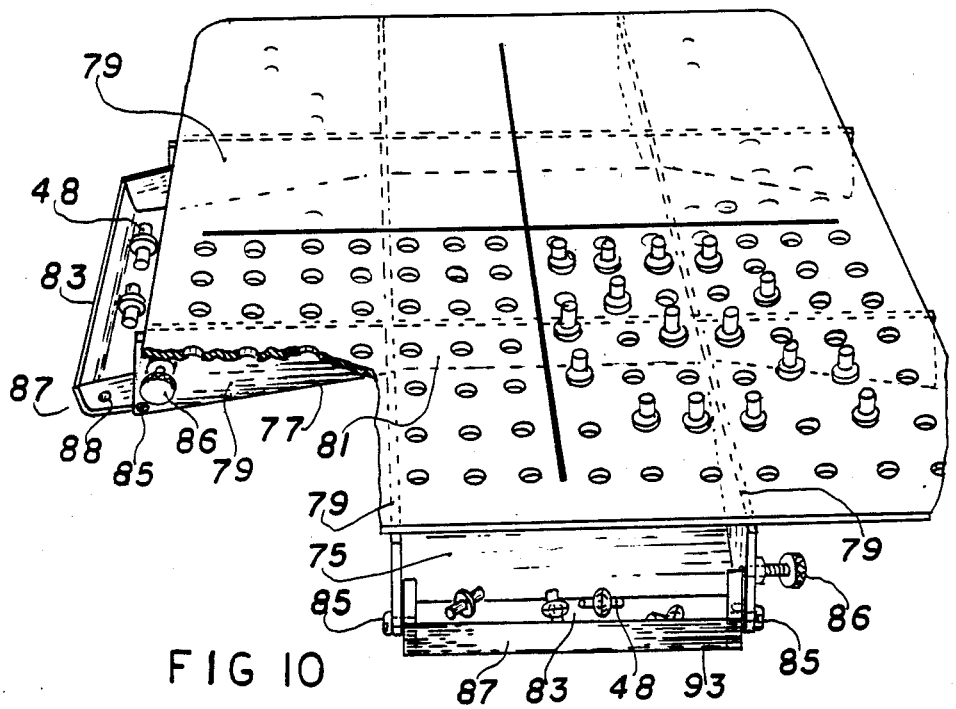
FIG. 10 is a partly sectioned side perspective view of another embodiment of the present invention.

While FIG. 1 shows the preferred embodiment of the present invention, board 20 can be supported by other forms of storage space for holding and storing the playing pieces, as shown in FIG. 10. This embodiment comprises a cavity 75 which has sloping bottom 77, side member 79, a back member 81, and a pivot-down front member 83, hinged on pivot pins 85. Front 83 incorporates a raised angular section 87, such that when front 83 is lowered, a raised portion 87 will be in a substantially vertical position. Sloping bottom 77 will cause the playing pieces to roll outward, and raised angular section 87 will hold them in a convenient position for each player to take out one at a time. After play is over, the pieces are returned to the cavity and the front is raised to a vertical position where it is locked by any convenient means, such as a spring loaded catch, or preferably a spigot thumb screw 86 engaging hole 88 in pivot-down front 83.

PULL-OUT DRAWER—FIG. 11

Figure 11:
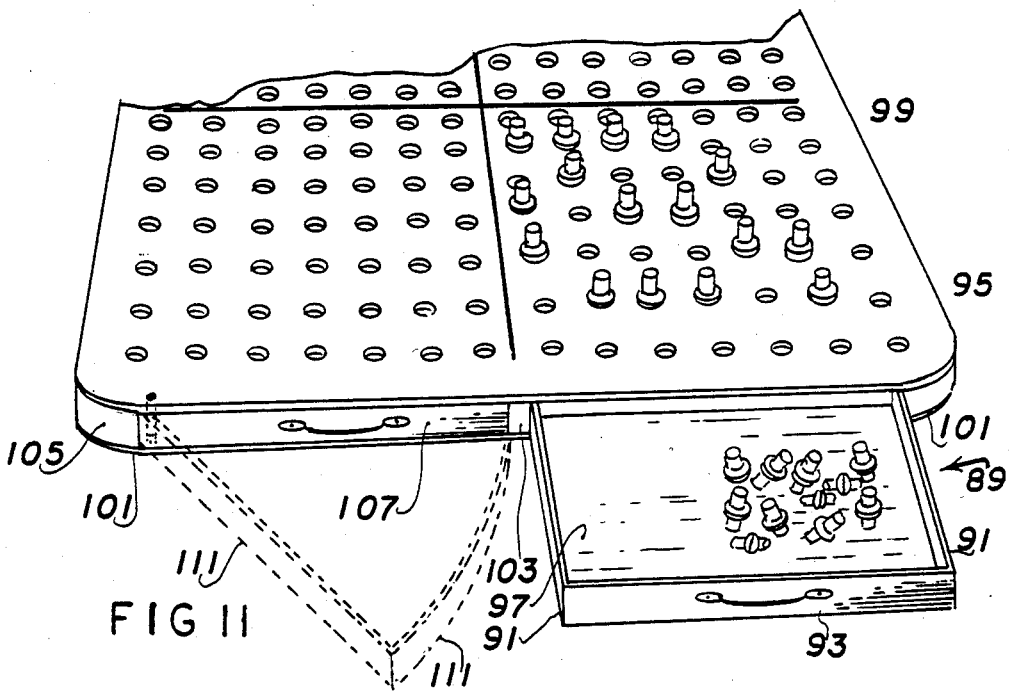
FIG. 11 is a perspective view of two other alternative types of storage compartments used for the storage and easy access of playing pieces, and also as means for elevating the board of the present invention.

Another embodiment for storage of the playing pieces and conveniently obtaining them for playing is shown in FIG. 11, in which a pull-out drawer 89, comprising sides 91, front 93, back 95, and bottom 97, is slidably and lockably fitted between elevated board 99 and base plate 101. These are held in a separated position by spacer members 103 and 105.

SWING-OUT DRAWER—FIG. 11

Alternatively, a fourth convenient means of storage for the playing pieces is a pivot drawer 107. Drawer 107 can swing out to the position shown by broken lines 111; here, the playing pieces are available to the player.

SWING-OUT DRAWER—FIGS. 5-6

Drawer bottom 44 is glued to wall 40 and cylinder end 46 to complete swing-out drawer 43. Drawer 43 may be made in one piece by injection molding of any suitable plastic.

Swing-out drawer is retained on post 32 by a friction washer 33 of any suitable type, which in turn is retained by a washer 35 secured by a countersunk screw 37. A felt pad 39 is glued to the base of washer 35 to prevent damage to furniture tops.

PLAYING PIECES—FIGS. 1 TO 3

Playing pieces or pegs 48 (FIGS. 1 to 3) have a widened middle portion 49 and two cylindrical dowel ends 50 to 52 which are smaller in diameter than the diameter of the ninety-six holes in board 20. The playing pieces or pegs are made in four different colors, preferably red, blue, yellow and black at one end, but all clear, colorless and transparent at the opposite end. There are one hundred of each color, and each kind is stored separately in one of the four swing-out drawers, these drawers being turned inward under the board when the game is not in use. Four score-keeping pegs 54 (FIG. 3B), also of colored plastic, have a stem 56 for inserting into the core holes 29 (FIG. 5). One of each of these score-keeping pegs is stored along with each set of colored playing pegs.

Figure 7:
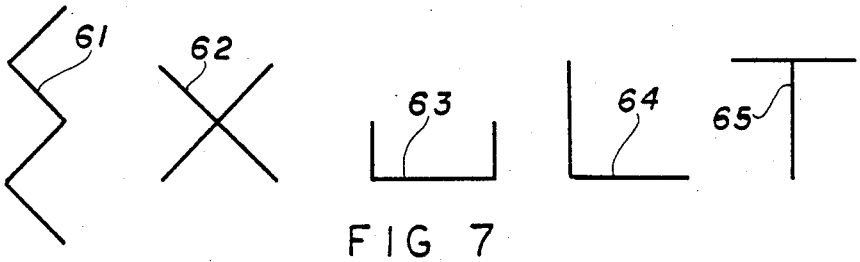
FIG. 7 is a diagram of the five patterns allowed in the game.

The object of the game is to insert five matching playing pegs 48 into five adjacent holes in the elevated board, to form any one of five simple patterns. These patterns, shown at 61, 62, 63, 64 and 65 in FIG. 7, constitute five letters of the alphabet, namely E, X, U, L and T, from which is derived the preferred trademark for the game, i.e., EXULT.

The patterns are formed by standing the colored pegs (colored side uppermost) in holes 24. When a pattern is formed, the player can claim it and take a score, which he or she does by moving his or her score peg to the next hole 29. He or she then inverts each of the five pegs which constitute the pattern, so that the clear, transparent end is now uppermost. The color of the inverted end shows faintly through the clear, transparent end; thus, the identity of the player who made the score remains evident. The clear, transparent ends also provide the means of cancelling the holes used, removing them from further play.

Figure 8:
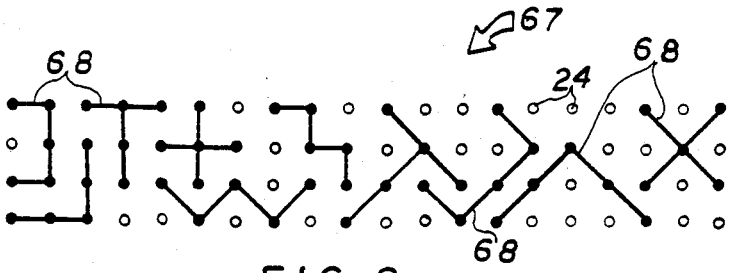
FIG. 8 is a top view of different positional relationships of the five permitted scoring patterns of FIG. 7.

Each letter or pattern (FIG. 8) can be formed in any position, e.g., horizontally, diagonally, sideways, inverted, backwards, etc., as shown by connection lines 68. The five patterns are indicated for permanent reference by reference markings 26 in FIG. 4 on each border 25 of the game board for the convenience of the players throughout the game.

Figure 9:
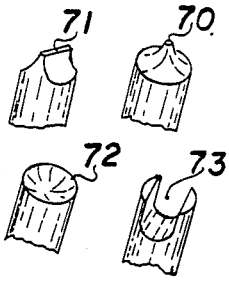
FIG. 9 is an enlarged perspective view of four different playing pieces with special shaped ends for recognition by the blind.

For blind players, each differently colored set of one hundred playing pieces has also a differently shaped end, as shown in FIG. 9. One set has a pin-pointed end 70; another set has a chizel-pointed end 71; another has a circle 72; and the last set has a groove 73 across the end. During play, the sensitive finger tips of the blind players can distinguish the playing pieces which have been inserted in the game board.

DESCRIPTION OF OPERATION

Assuming that two players are competing, two swing-out drawers on opposite sides of the board are turned outward. One player (chosen by a roll of dice or any other method) takes a peg and inserts it, colored side up, into any desired hole in any quarter of the board.

The other player then takes his or her turn and must insert one of his or her pegs into a hole in the same quarter.

The players continue in turn. Each player attempts to form any one of the five patterns permitted, while at the same time the opponent attempts to stop or block such attempts, while striving to make his own pattern.

When one player succeeds in forming one of the letters, E, X, U, L or T, he or she calls "Score!" and inverts the playing pieces that constitute the completed pattern, so that the clear, transparent side is up, then inserts his or her score peg in the first score hole. As play continues, both players find further patterns more difficult to form, as that quarter of the board gets progressively more crowded. Nevertheless, play remains confined to the quarter in which the first move was made until only four holes are left in that quarter, or until four complete patterns have been made and claimed in that quarter and four-fifths of a fifth pattern has been formed. In the latter case, the placement of a peg can be made in an adjacent quarter, either to complete the fifth pattern or to prevent its completion. Once this completing or preventing peg has been placed in the adjacent quarter, that quarter is considered to be opened for play. Play then continues both in the newly opened quarter and in the original one. A third and then a fourth quarter are opened by the same means, until the entire board has been brought into play. In order for play to move from the second quarter into the third, or from the third into the fourth, play remains confined until either only four unused holes remain in the quarter most recently opened, or four patterns have been completed and a move into the next quarter will either complete or prevent completion of a fifth pattern.

When play moves into a new quarter because only four or fewer holes remain in the previous quarter, the player who moves into the new quarter may place his peg in any hole he chooses. When play moves into a new quarter in order to complete or block a pattern which is four-fifths in the previous quarter, the player moving into the new quarter may place his playing piece only in a hole which will complete or block that pattern.

For the sake of counting completing patterns in order to open an adjacent quarter, patterns are considered to be "in" any particular quarter whenever three out of the five playing pieces comprising that pattern are to be found within that particular quarter. If only one or two playing pieces are present in that quarter, then the pattern is considered to be "outside."

Progress from quarter to quarter always moves in the same direction. If the first move into the second quarter is in a clockwise direction from the first quarter, then the third and fourth quarters must also be opened clockwise. But if the movement from the first quarter into a second is made in a counterclockwise direction, then the third and fourth quarters must likewise be made counterclockwise.

If at any time during the course of play, a player deliberately or inadvertently forms a pattern which he does not claim, an opponent can, upon noticing that pattern in his or her own turn, call out, "Gotcha!" and then remove the opponent's playing pieces and replace them with his or her own, inverting them and claiming the score. A player may also consciously choose to take the risk and fail to claim his or her score until his or her turn comes around again. If no opponent claims the pattern in the meanwhile, the player may then call out "Exult!" and not only take the score but also receive five additional playing pieces, which he or she may place anywhere in any quarter in play, taking the scores of as many patterns as he or she is able to complete.

When more than two persons play, players may cooperate in blocking scores. If one player sees than a second is about to score, he may call "Check!" to warn a third or fourth, enabling him or her to counter the second player.

The game is complete when all possible holes are filled or, alternatively, when all players agree that no more patterns are possible.

On completion of playing pieces are replaced in their respective drawers and the drawers inward. This prevents the playing pieces from falling out. The board then can be safely carried about or stored without fear of losing pieces.

Because the playing pieces are securely inserted in holes during play, they are most unlikely to be dislodged while travelling or by bumping, tipping, etc. Children or adults may play in bed or at home or in a hospital, without fear of dislodging the playing pieces.

Because many children are visually and spatially oriented, they can anticipate or recognize shapes readily, and are thus quite often able to defeat adults in the game of the present invention. Also, because so little instruction is required to learn the game, persons of different cultures and languages can play together readily and on an equal basis. Since the skills required to not depend on education or training, but only on concentration, anticipation, daring and ingenuity, the game of the present invention can be played and enjoyed by peoples of all nations.

While the dimensions given above are those preferred, they are not mandatory and can be increased, reduced, or changed in proportion. Also, while the materials listed are preferred, obviously the game apparatus can be made of other suitable materials, including metals, alloys, combinations of materials, or even precious metals and gems for the wealthy.

Further, while the colors given are preferred, these may be altered to suit individual tastes and needs.

The shapes of the playing pieces may be changed to suit blind persons. For instance, they may be made rought, soft, bent, flat, square, spiked, knobby, or of differing thermal conductivity (to give a semblance of heat or cold) and the like.

Because of the various colors and materials possible, and the decorative shape of the board invention, the game apparatus may be used as a decoration, to hang on a wall or place on a stand or otherwise displayed.

The board may also be fitted with legs of table height (not shown), to enable it to stand by itself, or may be fitted with supports on wheels for easy positioning near or between bedridden persons, or so that it can be moved back and forth between persons so disabled that they cannot be positioned side by side.

It is obvious that numerous other modifications can be made. For instance, the playing pieces can be replaced by dually colored discs fitting into recesses, or dually colored balls fitting into hollows, or dually colored cubes placed in holes or on flat surfaces, or even by marks made with pencils, crayons or the like on grid patterns on paper. However, any means for making five-point patterns as a means of scoring and blocking others from scoring is a version of the same invention. Accordingly, the full scope of the invention should be determined by the appended claims and their legal equivalents, and not by the examples given.

We claim:

1. A board game requiring strategic pattern formation skill, comprising, in combination:

(a) a board having a playing surface with a plurality of spaced holes therein, (b) at least two groups of playing pieces, each playing piece having a transparent end and a colored end opposite said transparent end, said ends both being sized for mating with the holes in said playing surface so that either end of any piece can be inserted into any of said holes and be retained in its hole until removal thereof, each playing piece having limiting means between said two ends thereof for limiting the degree of insertion thereof into said holes, the colored ends of the playing pieces of one group thereof being different from the colored ends of the playing pieces of the other group thereof.

2. The board game of claim 1 wherein said board is rigid and planar and in which the holes thereof are through holes.

3. The board game of claim 2 further including a plurality of playing piece storage compartments at opposite sides of said rigid planar board and attached to the underside of said board for holding playing pieces and for supporting said board in parallel relationship to but above a support surface, and including closure means for enabling each of said compartments to be accessible to a player on its side of said board and for closing said compartment to prevent loss of the playing pieces carried therein.

4. The board game of claim 3 wherein each of said compartments has an open upper end facing in the same direction as said playing surface and wherein said closure means comprises a pivot for enabling each compartment to rotate from a position under said board where the under surface of said board provides a closure to said compartment to a position where said open end of said compartment extends at least partially free of said board so that it can be accessed by a player.

5. The board game of claim 2 wherein said playing surface of said board is divided into a plurality of sectors, each sector having a plurality of said holes therein.

6. The board game of claim 5 wherein said board is square and said playing surface is divided into four sectors, each being substantially square.

7. The board game of claim 1 wherein said limiting means comprises a portion on each of said playing pieces which has a greater diameter than the rest of said playing piece.

8. The board game of claim 1 wherein said board also has a plurality of groups of scoring apertures and a plurality of groups of scoring pegs, each group of scoring pegs having a different common indicia thereon.

9. The board game of claim 1 wherein said indicia on said scoring pegs comprises a color and wherein said groups of playing pieces have corresponding colors to the respective colors of said groups of said scoring pegs.

10. The board game of claim 1 wherein said playing surface bears at least one pattern formation goal, said pattern comprising a plurality of hole indicia and interconnection lines, thereby to indicate to players how a pattern goal of the game may be attained by strategic placement of said playing pieces in said holes.

11. The board game of claim 10 wherein said playing surface bears a plurality of different pattern formation goals, each pattern comprising a plurality of hole indicia and interconnection lines.

12. A board game, comprising, in combination:

(a) a planar playing board having upper and lower planar surfaces which are parallel to each other, said upper surface having game-playing indicia thereon and including a plurality of spaced holes;

(b) a plurality of playing-piece storage and board support compartments at opposite sides of and under said board, each compartment being attached to the underside of said board for holding said board in parallel relationship to but above a support surface, said board also including closure means for enabling each of said compartments to be accessible to a player on its side of said board and for closing said compartment to prevent loss of the playing pieces carried therein; and (c) at least two groups of playing pieces, each playing piece having a transparent end and a colored end opposite said transparent end, said ends both being sized for mating with said spaced holes in said upper surface so that either end of any piece can be inserted into any of said spaced holes and be retained in its hole until removal thereof, each playing piece having limiting means between said two ends thereof for limiting the depth of insertion of each piece into any hole.

13. The board game of claim 12 wherein said board is rigid and in which the holes thereof are through holes.

14. The board game of claim 12 wherein said upper surface of said board is divided into a plurality of sectors, each sector having a plurality of said holes therein.

15. The board game of claim 12 wherein said board is square and said playing surface is dividied into four sectors, each being substantially square.

16. The board game of claim 12 wherein said limiting means comprises a portion on each of said playing pieces which has a greater diameter than the rest of said playing piece.

17. The board game of claim 12 wherein said board also has a plurality of groups of scoring apertures and a plurality of groups of scoring pegs, each group of scoring pegs having a different common indicia thereon.

18. The board game of claim 12 wherein said playing surface bears at least one pattern formation goal, said pattern comprising a plurality of hole indicia and interconnection lines, thereby to indicate to players how a pattern goal of the game may be attained by strategic placement of said playing pieces in said holes.

* * * * *